US006842593B2

(12) United States Patent
Cannon

(10) Patent No.: US 6,842,593 B2
(45) Date of Patent: Jan. 11, 2005

(54) METHODS, IMAGE-FORMING SYSTEMS, AND IMAGE-FORMING ASSISTANCE APPARATUSES

(75) Inventor: John C. Cannon, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/264,570

(22) Filed: Oct. 3, 2002

(65) Prior Publication Data

US 2004/0067073 A1 Apr. 8, 2004

(51) Int. Cl.[7] ..... G03G 15/00
(52) U.S. Cl. ..... 399/81; 399/80
(58) Field of Search ..... 399/81, 80, 75, 399/9, 18

(56) References Cited

U.S. PATENT DOCUMENTS

| | | | | |
|---|---|---|---|---|
| 4,500,971 A | * | 2/1985 | Futaki et al. | 704/274 |
| 5,604,771 A | | 2/1997 | Quiros | |
| 5,615,300 A | | 3/1997 | Hara et al. | |
| 5,692,225 A | | 11/1997 | Bernardi et al. | |
| 5,717,498 A | | 2/1998 | Itoh | |
| 6,253,184 B1 | * | 6/2001 | Ruppert | 704/275 |
| 6,260,018 B1 | | 7/2001 | Imade | |
| 6,366,651 B1 | | 4/2002 | Griffith et al. | |
| 6,577,825 B1 | * | 6/2003 | Gonnella, Jr. et al. | 399/38 |
| 2003/0048469 A1 | * | 3/2003 | Hanson | 358/1.14 |

FOREIGN PATENT DOCUMENTS

| | | | |
|---|---|---|---|
| JP | 57-161866 | * | 10/1982 |
| JP | 58-153954 | * | 9/1983 |
| JP | 3-194565 | * | 8/1991 |
| JP | 2001-100608 A | | 4/2001 |
| JP | 2001-100608 | * | 4/2001 |
| JP | 2002-318507 | * | 10/2002 |

OTHER PUBLICATIONS

"Changing Cues for Copiers"; Judy Tong; The New York Times; May 11, 2003; 1 pp.
"Xerox and Section 508: Designing for Accessibility"; http://www.xerox.com/go/xrx/template/009.jsp?view= Feature&cntry= USA&Xlang= en_US&ed_name . . . ; May 14, 2003; 1 pp.
"Xerox Software Makes Digital Copiers More Accessible for Workers who are Blind or Visually Impaired"; http:// www.xerox.com/go/xrx/template/inv_rel_news-room.jsp?ed_name= NR_2003March20_Copier_As . . . ; May 14, 2003; 2 pps.

(List continued on next page.)

*Primary Examiner*—Quana Grainger

(57) ABSTRACT

Methods, image-forming systems, and image-forming assistance apparatuses are described. According to one aspect, a method of informing a user with respect to operations of an image-forming device includes detecting a user attempting to effect an operation of an image-forming device configured to form hard images upon media and generating audible signals representing a human voice to communicate audible information to the user regarding the image-forming device and responsive to the detecting.

50 Claims, 2 Drawing Sheets

OTHER PUBLICATIONS

"Xerox Copier Assistant" http://www.xerox.com/go/xrx/equipment/product_details.jsp?tab+ Overview&prodID= Xerox; May 14, 2003; 2 pps.

®Xerox Document Centre® 535 Multifunction System (Printer/Copier) with Xerox Copier Assistant and Network Scanning and Fax http://www.xerox.com/go/xrx/template/009.jsp?view= Feature&cntry= USA&Xlang= en_US&ed_name . . . ; May 14, 2003; 11 pps.®.

"AT&T Natural Voices—Products and Services"; http://www.naturalvoices.att.com/products/tts_data.html; Oct. 3, 2002; 4 pps.

"AT&T Natural Voices—Home Page"; http://naturalvoices.att.com; Oct. 3, 2002; 1 pp.

"AT&T Natural Voices—Products and Services"; http://www.naturalvoices.att.com/products/index.html; Oct. 3, 2002; 2 pps.

* cited by examiner

METHODS, IMAGE-FORMING SYSTEMS, AND IMAGE-FORMING ASSISTANCE APPARATUSES

FIELD OF THE INVENTION

Aspects of the invention relate to methods, image-forming systems, and image-forming assistance apparatuses.

BACKGROUND OF THE INVENTION

Digital processing devices, such as personal computers, notebook computers, workstations, pocket computers, etc., are commonplace in workplace environments, schools and homes and are utilized in an ever-increasing number of educational applications, work-related applications, entertainment applications, and other applications. Peripheral devices of increased capabilities have been developed to interface with the processing devices to enhance operations of the processing devices and to provide additional functionality.

For example, digital processing devices depict images using a computer monitor or other display device. It is often desired to form hard images upon media corresponding to the displayed images. A variety of image-forming devices including printer configurations (e.g., inkjet, laser and impact printers) have been developed to implement imaging operations. More recently, additional devices have been configured to interface with processing devices and include, for example, multiple-function devices, copy machines and facsimile devices.

Image-forming devices often include instructional text upon housings and/or include a visual user interface, such as a graphical user interface (GUI), to visually convey information to a user regarding interfacing with the device, status of the device, and other information. Visual information may also be provided proximate to internal components of such devices to visually convey information regarding the components to service personnel, a user, or other entity.

Accordingly, disabled people, especially the blind, may experience difficulty in interfacing with printers and related devices inasmuch as diagnostics, status, and other information regarding device operations may be visually depicted. Additionally, unless a person, disabled or not, is experienced with servicing an image-forming device or performing operations with respect to the device, implementing service or other operations may be difficult without properly conveyed associated instructions.

Aspects of the present invention provide improved image-forming systems, image-forming assistance apparatuses and methods of instructing a user with respect to operations of image-forming devices. Additional aspects are disclosed in the following description and accompanying figures.

DESCRIPTION OF THE DRAWINGS

FIG. 4 is a flow chart depicting an exemplary methodology executable within an image-forming system.

DETAILED DESCRIPTION OF THE INVENTION

Figure 1:
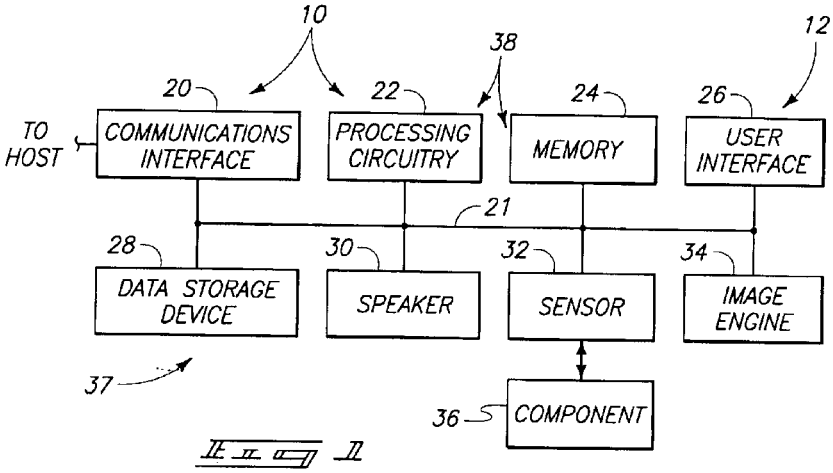
FIG. 1 is a functional block diagram of an exemplary image-forming device of an image-forming system.

According to one aspect, a method of informing a user with respect to operations of an image-forming device includes detecting a user attempting to effect an operation of an image-forming device configured to form hard images upon media and generating audible signals representing a human voice to communicate audible information to the user regarding the image-forming device and responsive to the detecting.

According to another aspect of the invention, an image-forming system comprises an image engine configured to form a plurality of hard images upon media, a sensor configured to detect a user attempting to effect an operation of the image-forming system with respect to the formation of the hard images, and a voice generation system coupled with the sensor and configured to generate audible signals representing a human voice to communicate audible information to the user regarding the image-forming system and responsive to the user attempting to effect the operation of the image-forming system.

According to an additional aspect of the invention, an image-forming system comprises imaging means for forming a plurality of hard images upon media, processing means for controlling the imaging means to form the hard images corresponding to image data, component means for effecting the forming of the hard images, wherein the component means is accessible by a user, and voice generation means for generating audible signals representing the human voice and comprising audible information regarding the component means.

According to yet another aspect of the invention, an image-forming assistance apparatus comprises an input configured to receive a detection signal indicating a presence of a user relative to a user-accessible component of an image-forming device configured to form a hard image upon media, a voice generation system coupled with the input and configured to access an object responsive to the reception of the detection signal and corresponding to the detection signal, and wherein the voice generation system is further configured to generate audible signals corresponding to the object and representing a human voice to communicate audible information regarding the image-forming device to the user.

According to an additional aspect, a data signal embodied in a transmission medium comprises processor-usable code configured to cause processing circuitry to detect a user attempting to effect an operation of an image-forming device configured to form hard images upon media and processor-usable code configured to cause processing circuitry to generate control signals for controlling the generation of audible signals representing a human voice to communicate audible information to the user regarding the image-forming device and responsive to the detecting.

According to another additional aspect, an article of manufacture comprises a processor-usable medium having processor-useable code embodied therein and configured to cause processing circuitry to detect a user attempting to effect an operation of an image-forming device configured to form hard images upon media and generate control signals for controlling the generation of audible signals representing a human voice to communicate audible information to the user regarding the image-forming device and responsive to the detecting.

FIG. 1 depicts an exemplary image-forming system 10 including an image-forming device 12 arranged to communicate with a host device (not shown). The host device may formulate and communicate image jobs to image-forming device 12 according to at least one aspect of the invention. Image jobs from the host device may be addressed directly to image-forming device 12, communicated via an appropriate server (not shown) of system 10, or otherwise provided to device 12. Exemplary host devices include personal computers, notebook computers, workstations, servers, and any other device configurations capable of communicating digital information. Host devices may be arranged to execute appropriate application programs, such as word processing programs, spreadsheets programs, or other programs creating associated image jobs wherein physical rendering of the jobs is desired.

Image-forming device 12 is arranged to generate hard images upon media such as paper, labels, transparencies, roll media, etc. Hard images include images physically rendered upon physical media. Exemplary image-forming devices 12 include printers, facsimile devices, copiers, multiple-function products (MFPs), or other devices capable of forming hard images upon media.

The exemplary configuration of image-forming device 12 of FIG. 1 includes a communications interface 20, processing circuitry 22, a memory 24, a user interface 26, a data storage device 28, a speaker 30, a sensor 32, an image engine 34 and a component 36. A bus 21 may be utilized to provide bi-directional communications within device 12. At least some of the depicted structure of image-forming device 12 is optional and other arrangements of device 12 configured to form hard images are possible. The exemplary embodiments herein will be discussed with reference to a printer configuration although aspects of the present invention apply to other image-forming device configurations capable of forming hard images.

Communications interface 20 is arranged to couple with an external network medium to implement input/output communications between image-forming device 12 and external devices, such as one or more host device. Communications interface 20, may be implemented in any appropriate configuration depending upon the application of image-forming device 12. For example, communications interface 20 may be embodied as a network interface card (NIC) in one embodiment.

Processing circuitry 22 may be implemented as a microprocessor arranged to execute executable code or programs to control operations of image-forming device 12 and process received imaged jobs. Processing circuitry 22 may execute executable instructions stored within memory 24, within data storage device 28 or within another appropriate device, and embodied as, for example, software and/or firmware instructions.

In the described exemplary embodiment, processing circuitry 22 may be referred to as a formatter or provided upon a formatter board. Processing circuitry 22 may be arranged to provide rasterization, manipulation and/or other processing of data to be imaged. Exemplary data to be imaged in device 12 may include page description language (PDL) data, such as printer command language (PCL) data or Postscript data. Processing circuitry 22 operates to rasterize the received PDL data to provide bitmap representations of the received data for imaging using image engine 34. Processing circuitry 22 presents the rasterized data to the image engine 34 for imaging. Image data may refer to any data desired to be imaged and may-include application data (e.g., in a driverless printing environment), PDL data, rasterized data or other data.

Memory 24 stores digital data and instructions. For example, memory 24 is configured to store image data, executable code, and any other appropriate digital data to be stored within image-forming device 12. Memory 24 may be implemented as random access memory (RAM), read only memory (ROM) and/or flash memory in exemplary configurations.

User interface 26 is arranged to depict status information regarding operations of image-forming device 12. Processing circuitry 22 may monitor operations of image-forming device 12 and control user interface 26 to depict such status information. In one possible embodiment, user interface 26 is embodied as a liquid crystal display (LCD) although other configurations are possible. User interface 26 may also include a keypad or other input device for receiving user commands or other input. Aspects described herein facilitate communication of information conveyed using user interface 26 to a user. Additional details of an exemplary user interface 26 are described below with reference to FIG. 2.

Data storage device 28 is configured to store relatively large amounts of data in at least one configuration and may be configured as a mass storage device. For example, data storage device 28 may be implemented as a hard disk (e.g., 20 GB, 40 GB) with associated drive components. Data storage device 28 may be arranged to store executable instructions usable by processing circuitry 22 and image data of image jobs provided within image-forming device 12. For example, data storage device 28 may store received data of imaged jobs, processed data of image jobs, or other image data. As described below, data storage device 26 may additionally store data files (or other objects as described below) utilized to convey information regarding device 12 to a user.

Speaker 30 is arranged to communicate audible signals. According to aspects of the invention, speaker 30 generates audible signals to communicate information regarding image-forming device 12. The generated audible signals are utilized in exemplary configurations to assist users with operations of image-forming device 12. The audible signals may be generated using the data files stored within device 28 in one arrangement.

Sensor 32 is arranged to detect a presence of a user and to output a detection signal indicating the presence of the user. In one embodiment, sensor 32 may be arranged to detect a user attempting to effect an operation of the image-forming system 10 with respect to the formation of hard images. According to one embodiment, sensor 32 may be configured to detect the interfacing of a user with respect to component 36 comprising a user-accessible component (e.g., a user may manipulate the component 36 to effect an operation to implement the formation of hard images). Exemplary sensors 32 are heat, light, motion or pressure sensitive, although other sensor configurations may be utilized to detect the presence of a user.

Component 36 represents any component of image-forming device 12 and may be accessible by a user or may have associated instructions that are to be communicated to a user. Exemplary components 36 include user interface 26, media (e.g., paper) trays, doors to access internal components of device 12, media path components (e.g., rollers, levers, etc.), toner assemblies, etc. Responsive to the detection of a user accessing a component, speaker 30 may be controlled to output appropriate audible signals to instruct the user with respect to operations of the accessed component 36 and/or other operations or components of image-forming device 12.

Although only a single sensor 32 is shown in FIG. 1, it is to be understood that a plurality of sensors 32 may be implemented in image-forming system 10 or device 12 to monitor a plurality of components 36. Additionally, a plurality of configurations of sensors 32 are contemplated corresponding to the various configurations of components 36 to be monitored.

Accordingly, system 10 and/or image-forming device 12 are arranged to assist a user with respect to the formation of hard images or other operations using the device 12. Component parts of image-forming device 12 (e.g., processing circuitry 22, memory 24, device 28, speaker 30, sensor 32, component 36) arranged to assist a user with respect to the formation of hard images or other operations may be referred to as an image-forming assistance apparatus 37. In other embodiments, the image-forming assistance apparatus 37 may be partially or completely external of image-forming device 12. Additional details regarding exemplary image-forming assistance apparatuses 37 are described below.

Image engine 34 uses consumables to implement the formation of hard images. In one exemplary embodiment, image engine 34 is arranged as a print engine and includes a developing assembly and a fusing assembly (not shown) to form the hard images using developing material, such as toner, and to affix the developing material to the media to print images upon media. Other constructions or embodiments of image engine 34 are possible including configurations for forming hard images within copy machines, facsimile machines, MFPs, etc. Image engine 34 may include internal processing circuitry (not shown), such as a microprocessor, for interfacing within processing circuitry 22 and controlling internal operations of image engine 34.

As mentioned above, exemplary aspects of the invention provide the generation of audible signals to assist a user with respect to operations of image-forming system 10 and/or device 12. Exemplary embodiments of the invention generate the audible signals to represent a human voice to assist a user with respect to image-forming system 10 and/or device 12. Audible signals representing the human voice may instruct a user regarding operations with respect to the formation of hard images, with respect to operations of component 36, or with respect to any other information regarding operations of image-forming system 10 and/or device 12.

Image-forming assistance apparatus 37 may be implemented as a voice generation system 38 to audibly convey information to a user. Appropriate instructions for controlling processing circuitry 22 to implement voice generation operations may be stored within memory 24 and device 28. Processing circuitry 22 may execute the instructions, process files stored within data storage device 28 (or other objects described below), and provide appropriate signals to speaker 30 after the processing to generate audible signals representing a human voice. In one configuration, voice generation system 38 utilizes text-to-speech (TTS) technology to generate audible signals representing the human voice to communicate information to the user regarding the image-forming system 10 and/or the image-forming device 12. Exemplary text-to-speech technology is described in U.S. Pat. No. 5,615,300, incorporated by reference herein. Text-to-speech systems are available from AT&T Corp. and are described at http://www.naturalvoices.att.com, also incorporated by reference herein.

As mentioned above, a plurality of data files may be stored within data storage device 28. The processing circuitry 22 may detect via sensor 32 the presence of a user-accessing component 36 and select an appropriate data file responsive to the accessing by the user. For example, a plurality of the sensors 32 may be utilized in device 12 as mentioned above and output respective detection signals responsive to the detection of a user accessing components 36. The processing circuitry 22 may receive the signals via an input (e.g., coupled with bus 21) and may select the appropriate files or other objects of device 28 responsive to the respective sensors 32 detecting the presence of a user. Alternatively, processing circuitry 22 may select files or other objects according to other criteria including states of mode of operation of image-forming device 12 (e.g., finishing imaging of an image job) or responsive to other factors. The files or other objects accessed may be arranged to cause voice generation system 38 to generate the audible signals comprising audible instructions regarding operations of the image-forming device 12, operations of image-forming system 10, operations of components 36, and/or other information regarding the formation of hard images. The instructions may be tailored to the specific sensor 32 indicating the presence of a user or to other criteria. For example, and as described below, the files or other objects controlling the generation of the audible signals may be tailored to inputs received via user interface 26.

Figure 2:
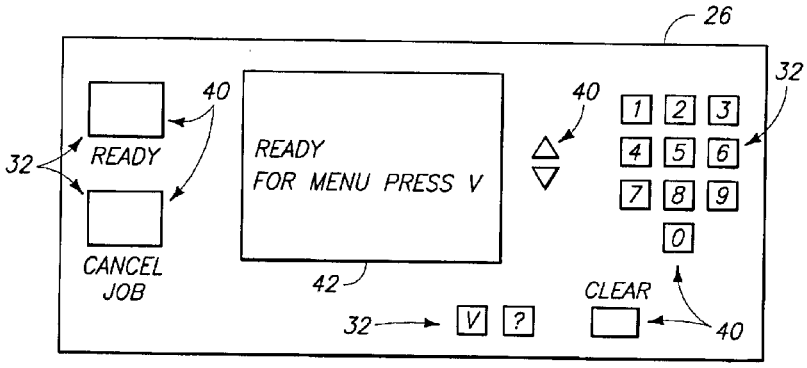
FIG. 2 is an illustrative representation of an exemplary user interface of an image-forming device.

Referring to FIG. 2, an exemplary user interface 26 in the form of a control panel is depicted. Exemplary user interface 26 includes a plurality of input buttons 40 arranged to receive inputs from a user. The depicted user interface 26 additionally includes a graphical display 42, such as a graphical user interface (GUI), configured to display alphanumerical characters for conveying visual information to a user. For example, error conditions, status information, print information, or other information can be conveyed using display 42. An exemplary display 42 is implemented as a liquid crystal display (LCD). The depicted arrangement of user interface 26 is exemplary and other display configurations may be utilized.

According to one operational arrangement, input buttons 40 may include appropriate sensors 32 configured to detect a presence of a user attempting to depress input buttons 40 or otherwise accessing controls of interface 26. Exemplary sensors 32 are arranged to detect a user's finger proximately located to the respective input buttons 40. In such an arrangement, the presence of the user may be detected without the user actually depressing the respective input buttons 40. Instructional audible operations described herein may be initiated responsive to the detection. For example, the instructions may be tailored to or associated with the respective buttons 40 detecting the presence of the user.

In another arrangement, one of input buttons 40 may be arranged to provide or initiate audible instructional operations. For example, a user could depress the "V" input button 40 for a predetermined amount of time whereupon the image-forming device 12 would enter an instructional mode of operation. Thereafter, input buttons 40 when depressed would result in the generation of audible signals and disable the associated function of the input buttons 40 until subsequent reactivation. Upon reactivation, image-forming device 12 would reenter the functional or operational mode wherein imaging operations may proceed responsive to inputs received via buttons 40. In one arrangement, image-forming device 12 may revert to the operational mode after operation in the instructional mode for a predetermined amount of time wherein no input buttons 40 are selected (e.g., timeout operations).

Accordingly, following appropriate detection of the presence of a user, image-forming device 12 may operate to audibly convey information to a user. Exemplary information to be audibly communicated to a user may include information regarding the user interface 26 as mentioned above. For example, audibly communicated information may correspond to information depicted using display 42. Additionally, the audibly conveyed information or messages may correspond to a selected button 40 or may instruct the user to select another input button 40 and audibly describe a position of the appropriate other input button 40 with respect to a currently sensed input button 40.

The audible messages may be more complete than text messages depicted using display 42. For example, as a user places a finger on a menu key, system 38 may state, "This is the menu key. Press once to hear the next menu option. After you hear the desired menu option, press the Select button to your right to access that option." The user may move a finger along other input buttons 40 and system 38 may convey audible messages regarding the respective buttons 40 and the user may press the Select or other appropriate button 40 once it is located.

If a sensor 32 is provided adjacent an appropriate component 36 utilized to effect imaging operations (e.g., media path components, media trays, access doors, etc.), the voice generation system 38 may audibly communicate information with respect to operations of the respective component 36 or audibly instruct a user how to correct the operations of the respective component 36 (e.g., instruct a user where a paper jam occurred relative to an accessed component 36). If a user accesses an incorrect component 36 also having a sensor 32, voice generation system 38 may instruct the user regarding the access of the incorrect component 36 and audibly instruct the user where to locate the appropriate component 36 needing attention.

A message identifier may be utilized to identify files or other objects to be utilized to generate voice communications. For example, processing circuitry 22 may access a look-up table (e.g., within memory 24) to select an appropriate identifier responsive to the reception of a detection signal from a given sensor 36. The identifier may identify appropriate files or other objects in data storage device 28 to be utilized to communicate messages to the user responsive to the detection signal. Voice messages in one embodiment may correspond to messages depicted using display 42. Identifiers may be utilized to expand upon information communicated using display 42 of user interface 26 by identifying files or other objects containing information in addition to the information depicted using display 42. In other implementations, processing circuitry 22 may proceed to directly obtain an appropriate file or other object from device 28 corresponding to a particular sensor 36 detecting the user and without extraction of an appropriate message identifier.

The files or other objects are processed by processing circuitry 22 and cause the generation of audible signals in the form of human voice instructional messages using speaker 30. As mentioned above, the instructional messages may convey information to a user regarding operations of components 36 of system 10 and/or device 12. In an additional example, a given image-forming device 12 may include a plurality components 36 comprising paper trays. When a user touches or attempts to access one of the trays, voice generation system 38 may audibly identify the tray being touched or accessed. For example, voice generation system 38 may tell a person there is no more paper in tray number one. Thereafter, the voice generation system 38 may audibly assist a person with identifying which of the plurality of paper trays is tray number one. In one operational aspect, the user merely has to touch a tray to invoke automatic audible identification of the tray using the voice generation system 38 and responsive to sensed presence of the user via sensor 32. In another example, when a user touches an appropriate component 36 such as a lever including a corresponding sensor 32, the voice generation system 38 may state, "This is lever number two. You must first turn lever number one as the next step in diagnosing this error." Other exemplary messages include "This is the toner unit. Pull up and out to remove." Such instructions are exemplary and are useful to any user-accessing image-forming device 12.

Typically, users whether handicapped or not, appreciate instructional assistance when accessing components 36 of an image-forming device such as opening covers/doors of an image-forming device 12. For example, when experiencing a paper jam or changing toner, an individual may have uncertainty with respect to various components requiring attention. A particular individual may not know which lever to turn or be able to identify the mechanical structure of the image-forming device 12 requiring attention. Accordingly, sensors 32 may be provided to sense the presence of the user and to initiate the generation of the appropriate messages for servicing the image-forming device 12.

Figure 3:
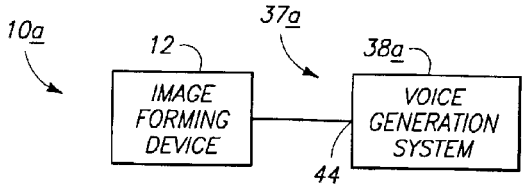
FIG. 3 is a functional block diagram of another exemplary image-forming system.
Figure 2:
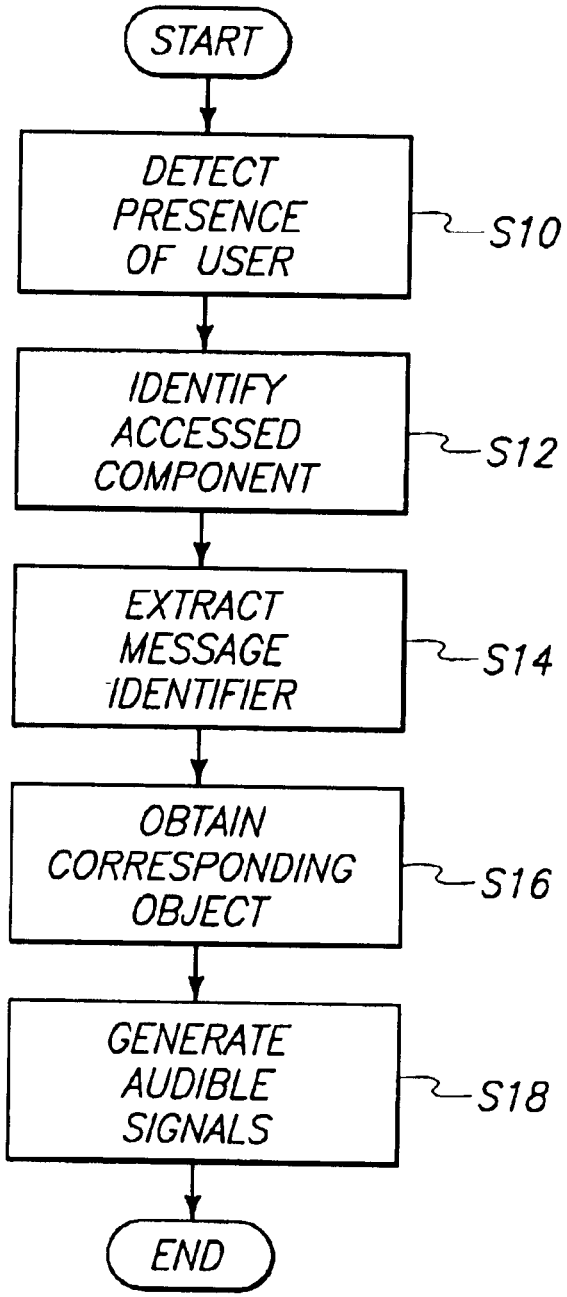

Referring to FIG. 3, an alternative configuration of an image-forming system is depicted with respect to reference 10*a*. Like numerals are used herein to refer to like components with differences therebetween being represented by a suffix such as "a." The illustrated image-forming system 10*a* includes an image-forming device 12 coupled with a voice generation system 38*a*. In the depicted exemplary embodiment, voice generation system 38*a* is implemented at least partially externally of image-forming device 12. In one application, voice generation system 38*a* is proximately located adjacent to the image-forming device 12.

For example, voice generation system 38*a* may be implemented as a separate device that interfaces with image-forming device 12 via communications interface 20 of device 12 or other appropriate medium. The configuration of FIG. 3 may be advantageous to interface with numerous different types of existing image-forming devices 12, or to minimize redesign or impact upon existing image-forming devices 12 to implement aspects of the invention.

Image-forming device 12 of FIG. 3 may be configured to externally communicate detection signals received from appropriate sensors 32 to system 38*a* and corresponding to users attempting to access or effect operations of image-forming device 12. The detection signals may be externally communicated or otherwise applied to an input 44 of voice generation system 38*a* that proceeds to audibly instruct or convey information to the users responsive to the sensed inputs. Voice generation system 38*a* may internally store a plurality of files or objects corresponding to messages to be communicated, process the files or objects, and communicate audible messages responsive to the reception of appropriate detection signals and processed files or objects. Alternatively, the image-forming device 12 may externally communicate files or objects (e.g., corresponding to text messages depicted using the display 42 of the image-forming device) and voice generation system may receive the files or objects and generate the audible messages responsive to the files or objects. For example, the communicated file or object may comprise the above-described detection signal indicating the generation of an audible message corresponding to the file or object is appropriate. Accordingly, components of the assistance apparatuses embodied as voice generation systems may be provided internally and/or externally of device 12.

Above operations of exemplary systems 36, 38 are described as generating audible messages using stored files or objects. In addition to the above-described files, exemplary objects may include text embedded in software and/or firmware, textual translations of icons depicted using display 42, messages which are not predefined or stored within device 12 but are generated or derived by processing circuitry 22 during operations of device 12, or other sources of messages to be conveyed to a user.

Referring to FIG. 4, an exemplary operational method is illustrated. The depicted methodology may be embodied as executable code and executed by processing circuitry 22 and/or other appropriate circuitry of systems 10, 10*a* (e.g., circuitry of system 38*a*) to facilitate the generation of audible signals as described herein. Other methods are possible including more, less, or alternative steps.

As shown in FIG. 4, the appropriate circuitry detects the presence of a user at a step S10. For example, the circuitry may receive an appropriate detection signal from one of the sensors.

At a step S12, the circuitry operates to identify the accessed component corresponding to the particular sensor that outputted the signal.

At a step S14, the circuitry operates to extract an appropriate message identifier to identify the message to be audibly communicated.

At a step S16, the circuitry may obtain an appropriate object corresponding to the extracted message identifier and which contains a digital representation of the audible signals to be communicated.

At a step S18, the circuitry operates to control the generation of audible signals via the speaker and using the object of step S16.

Improved structure and methods for communicating information with respect to operations of an image-forming device and/or an image-forming system to a user are described. The structure and methods enable disabled individuals to interact with image-forming devices with assurance and remove uncertainty facilitating more comprehensive interactions. The structural and methodical aspects benefit non-handicapped persons also inasmuch as the image-forming system 10 and/or device 12 are able to provide more complete instructions and explanations with respect to operations of the image-forming system 10 and/or image-forming device 12.

The methods and other operations described herein may be implemented using appropriate processing circuitry configured to execute processor-usable or executable code stored within appropriate storage devices or communicated via an external network. For example, processor-usable code may be provided via articles of manufacture, such as an appropriate processor-usable medium comprising, for example, a floppy disk, hard disk, zip disk, or optical disk, etc., or alternatively embodied within a transmission medium, such as a carrier wave, and communicated via a network, such as the Internet or a private network.

The protection sought is not to be limited to the disclosed embodiments, which are given by way of example only, but instead is to be limited only by the scope of the appended claims.

What is claimed is:

1. A method of informing a user with respect to operations of an image-forming device, the method comprising:

detecting a user attempting to effect an operation of an image-forming device configured to form hard images upon media;

generating audible signals representing a human voice to communicate audible information to the user regarding the image-forming device and responsive to the detecting;

wherein the detecting comprises detecting the user attempting to access a user-accessible component of the image-forming device configured to effect the operation; and wherein the generating comprises generating the audible signals to communicate audible information regarding the user-accessible component.

2. The method of claim 1 wherein the detecting comprises detecting the user attempting to effect the operation of the image-forming device to form hard images.

3. The method of claim 1 wherein the generating comprises generating the audible signals to audibly instruct the user regarding the operation of the image-forming device.

4. The method of claim 1 wherein the generating comprises generating using a text-to-speech engine.

5. The method of claim 1 further comprising a user interface configured to depict a textual message to convey information to the user.

6. The method of claim 5 wherein the detecting comprises detecting the user accessing the user interface of the image-forming device.

7. The method of claim 5 wherein the detecting comprises detecting the user accessing an input button of the user interface.

8. The method of claim 5 wherein the generating comprises generating the audible signals to convey audible information corresponding to the textual message to the user.

9. The method of claim 1 wherein the generating comprises generating using an apparatus at least partially external of the image-forming device.

10. The method of claim 1 wherein the generating comprises generating using the image-forming device.

11. The method of claim 1 further comprising providing the image-forming device comprising a printer configured to print the hard images.

12. The method of claim 1 wherein the generating comprises generating the audible signals before the operation of the image-forming device is effected.

13. An image-forming system comprising:

an image engine configured to form a plurality of hard images upon media;

a sensor configured to detect a user attempting to effect an operation of the image-forming system with respect to the formation of the hard images;

a voice generation system coupled with the sensor and configured to generate audible signals representing a human voice to communicate audible information to the user regarding the image-forming system and responsive to the user attempting to effect the operation of the image-forming system; and wherein the sensor is configured to detect the user attempting to access a component configured to implement operations with respect to a media path arranged to provide the media to the image engine.

14. The system of claim 13 wherein the voice generation system is configured to generate the audible signals comprising audible instructions regarding the operation of the image-forming system.

15. The system of claim 13 wherein the voice generation system comprises a text-to-speech system.

16. The system of claim 13 further comprising a user interface, and wherein another sensor is configured to detect the user accessing the user interface.

17. The system of claim 16 wherein the voice generation system is configured to generate the audible signals comprising audible information regarding the user interface.

18. The system of claim 16 wherein the voice generation system is configured to generate the audible signals comprising audible information corresponding to information depicted using the user interface.

19. The system of claim 13 wherein another sensor is configured to detect the user attempting to access a tray configured to hold the media.

20. The system of claim 13 wherein the image engine comprises a print engine.

21. The system of claim 13 wherein the voice generation system is configured to generate the audible signals before the operation of the image-forming system is effected.

22. An image-forming system comprising:

imaging means for forming a plurality of hard images upon media;

processing means for controlling the imaging means to form the hard images corresponding to image data;

component means for effecting the forming of the hard images, wherein the component means is accessible by a user;

voice generation means for generating audible signals representing the human voice and comprising audible information regarding the formation of hard images using the component means; and wherein the component means comprises user interface means for displaying information to the user.

23. The system of claim 22 wherein the voice generation means comprises means for generating the audible signals comprising audible instructions regarding an operation of the component means.

24. The system of claim 22 wherein the voice generation means comprises means for generating the audible signals responsive to a user accessing the component means.

25. The system of claim 22 further comprising sensor means for detecting the user accessing the component means, and wherein the voice generation means comprises means for generating the audible signals responsive to the detecting using the sensor means.

26. The system of claim 22 wherein the voice generation means comprises the processing means.

27. The system of claim 22 wherein the voice generation means comprises means for generating the audible signals comprising audible information regarding the formation of the hard images before the hard images are formed.

28. An image-forming assistance apparatus comprising:

an input configured to receive a detection signal indicating a presence of a user relative to a user-accessible component of an image-forming device configured to form a hard image upon media;

a voice generation system coupled with the input and configured to access an object responsive to the reception of the detection signal and corresponding to the detection signal;

wherein the voice generation system is further configured to generate audible signals corresponding to the object and representing a human voice to communicate audible information regarding the image-forming device to the user; and wherein the voice generation system is external of the image-forming device.

29. The apparatus of claim 28 wherein the audible information comprises information relative to an operation of the image-forming device.

30. The apparatus of claim 28 wherein the audible information comprises information relative to an operation of the user-accessible component.

31. The apparatus of claim 28 wherein the voice generation system is configured to receive the object from a data storage device of the image-forming device.

32. The apparatus of claim 28 wherein the detection signal comprises the object.

33. The apparatus of claim 28 wherein the input is adapted to couple with the image-forming device.

34. The apparatus of claim 28 wherein the voice generation system comprises a text-to-speech system.

35. A data signal embodied in a transmission medium comprising:

processor-usable code configured to cause processing circuitry to detect a user attempting to effect an operation via a selected one of a plurality of inputs of a user interface of an image-forming device configured to form hard images upon media; and processor-usable code configured to cause processing circuitry to generate control signals for controlling the generation of audible signals representing a human voice to communicate audible information to the user identifying the selected one input of the user interface of the image-forming device and responsive to the detecting.

36. The signal according to claim 35 further comprising processor-usable code configured to cause processing circuitry to detect the user attempting to effect the operation of the image-forming device to form hard images.

37. The signal according to claim 35 further comprising processor-usable code configured to cause processing circuitry to generate the control signals to audibly instruct the user regarding the operation of the image-forming device.

38. The signal according to claim 35 further comprising processor-usable code configured to cause processing circuitry to detect the user attempting to access a user-accessible component of the image-forming device configured to effect the operation.

39. The signal according to claim 38 further comprising processor-usable code configured to cause processing circuitry to generate the control signals to communicate audible information regarding the user-accessible component.

40. The signal according to claim 35 wherein the selected one input has an associated function and the processor-usable code configured to cause the processing circuitry to detect comprises processor-usable code configured to cause the processing circuitry to detect without initiating the function.

41. An article of manufacture comprising:

a processor-usable medium having processor-useable code embodied therein and configured to cause processing circuitry to:

detect a user attempting to effect an operation of an image-forming device configured to form hard images upon media, wherein the operation includes disabling a plurality of functions of a plurality of inputs of a user interface; and generate control signals for controlling the generation of audible signals representing a human voice to communicate audible information to the user regarding at least one of the disabled functions of the image-forming device and responsive to the detecting.

42. The article according to claim 41 wherein the processor-usable medium includes processor-usable code embodied therein and configured to cause processing circuitry to generate the control signals to audibly instruct the user regarding the operation of the image-forming device.

43. The article according to claim 41 wherein the at least one of the disabled functions corresponds to a selected one of the inputs.

44. The article according to claim 41 wherein the audible information communicated regarding the at least one disabled function is responsive to selection of an input which corresponds to the at least one disabled function.

45. A method of informing a user with respect to operations of an image-forming device, the method comprising:

detecting a user attempting to effect an operation of an image-forming device configured to form hard images upon media;

generating audible signals representing a human voice to communicate audible information to the user regarding the image-forming device and responsive to the detecting; and wherein the generating comprises generating using a text-to-speech engine.

46. A method of informing a user with respect to operations of an image-forming device, the method comprising:

detecting a user attempting to effect an operation of an image-forming device configured to form hard images upon media;

generating audible signals representing a human voice to communicate audible information to the user regarding the image-forming device and responsive to the detecting; and using a user interface, depicting a textual message to convey information to the user, and wherein the generating comprises generating the audible signals to convey audible information corresponding to the textual message to the user.

47. An image-forming system comprising:

an image engine configured to form a plurality of hard images upon media;

a sensor configured to detect a user attempting to effect an operation of the image-forming system with respect to the formation of the hard images;

a voice generation system coupled with the sensor and configured to generate audible signals representing a human voice to communicate audible information to the user regarding the image-forming system and responsive to the user attempting to effect the operation of the image-forming system; and wherein the voice generation system comprises a text-to-speech system.

48. An image-forming system comprising:

an image engine configured to form a plurality of hard images upon media;

a sensor configured to detect a user attempting to effect an operation of the image-forming system with respect to the formation of the hard images;

a voice generation system coupled with the sensor and configured to generate audible signals representing a human voice to communicate audible information to the user regarding the image-forming system and responsive to the user attempting to effect the operation of the image-forming system;

a user interface and wherein the sensor is configured to detect the user accessing the user interface; and wherein the voice generation system is configured to generate the audible signals comprising audible information regarding the user interface.

49. An image-forming system comprising:

an image engine configured to form a plurality of hard images upon media;

a sensor configured to detect a user attempting to effect an operation of the image-forming system with respect to the formation of the hard images;

a voice generation system coupled with the sensor and configured to generate audible signals representing a human voice to communicate audible information to the user regarding the image-forming system and responsive to the user attempting to effect the operation of the image-forming system; and wherein the sensor is configured to detect the user attempting to access a tray configured to hold the media.

50. An image-forming assistance apparatus comprising:

an input configured to receive a detection signal indicating a presence of a user relative to a user-accessible component of an image-forming device configured to form a hard image upon media;

a voice generation system coupled with the input and configured to access an object responsive to the reception of the detection signal and corresponding to the detection signal;

wherein the voice generation system is further configured to generate audible signals corresponding to the object and representing a human voice to communicate audible information regarding the image-forming device to the user; and wherein the voice generation system comprises a text-to-speech system.

* * * * *